US005271463A

United States Patent [19]

Jennings, Jr.

[11] Patent Number: 5,271,463

[45] Date of Patent: Dec. 21, 1993

[54] METHOD OF RECOVERING ADDITIONAL OIL FROM FINES AND RESIDUE RECOVERED FROM VISCOUS OIL RESERVOIRS

[75] Inventor: Alfred R. Jennings, Jr., Plano, Tex.

[73] Assignee: Mobil Oil Corporation, Fairfax, Va.

[21] Appl. No.: 936,479

[22] Filed: Aug. 28, 1992

[51] Int. Cl.[5] ..... E21B 43/20; E21B 43/22; E21B 43/26

[52] U.S. Cl. ..... 166/271; 166/308

[58] Field of Search ..... 166/308, 271, 268, 305.1, 166/280, 250, 273, 274

[56] References Cited

U.S. PATENT DOCUMENTS

| | | | |
|---|---|---|---|
| 3,335,798 | 8/1967 | Querio et al. | 166/305.1 |
| 3,896,877 | 7/1975 | Vogt, Jr. et al. | 166/250 |
| 4,113,632 | 9/1978 | Stournas et al. | 252/8.55 |
| 4,549,608 | 10/1985 | Stowe et al. | 166/280 |
| 4,629,000 | 12/1986 | Hurd | 166/274 |
| 4,787,452 | 11/1988 | Jennings, Jr. | 166/272 |
| 4,828,030 | 5/1989 | Jennings, Jr. | 166/271 |
| 4,844,158 | 7/1989 | Jennings, Jr. | 166/267 |

*Primary Examiner*—Stephen J. Novosad
*Attorney, Agent, or Firm*—Alexander J. McKillop; George W. Hager, Jr.; Charles A. Malone

[57] ABSTRACT

This invention is directed to a method for recovering residual oil from produced fines and solid materials which are obtained during the production of viscous oil from a formation. The fines and produced materials are injected into a formation with or without fracturing for their disposal. Once in the formation, a non-thermal enhanced oil recovery method is used to remove residual oil from the fines or solid materials. Use of this method provides an inexpensive and environmentally safe method for recovering residual oil from formation fines or solids.

4 Claims, No Drawings

METHOD OF RECOVERING ADDITIONAL OIL FROM FINES AND RESIDUE RECOVERED FROM VISCOUS OIL RESERVOIRS

FIELD OF THE INVENTION

This invention relates to the treatment of formations surrounding hydrocarbon production areas, oil wells, gas wells or similar hydrocarbon containing formations. It is particularly directed to the recovery of residual oil from fines or residue obtained during viscous oil recovery operations.

BACKGROUND OF THE INVENTION

Much of today's unrecovered oil is in the form of viscous, low gravity crude oil found in shallow, low temperature reservoirs. These deposits of viscous oil are the target of substantial enhanced oil recovery efforts in the industry. Most of these reservoirs contain very high saturations of viscous oil in a loosely consolidated or unconsolidated sandstone or siltstone matrix. A successful means of recovering this viscous oil is to thin the oil thermally (steam or combustion) and produce the thinned oil to the surface. During production, substantial quantities of formation fluids and formation fines are produced to the surface, suspended in the crude oil. The produced fluid is then treated to separate the oil, water and solids.

The produced oil is then sold and the water is injected into water disposal wells, leaving the fines and formation sand. These fines and formation sands have been disposed of by injecting or pumping them into a formation. One such method for disposal of produced formation fines obtained during oil recovering is disclosed in U.S. Pat. No. 4,787,452 which issued to Jennings, Jr. on Nov. 28, 1988. Another method for recovering viscous oil by removing fines therefrom is discussed in U.S. Pat. No. 4,828,030 which issued to Jennings, Jr. on May 9, 1989. The produced fines were mixed into a desired hydraulic fracturing fluid which fluid is then used to fracture the formation. Once the formation has been treated, additional fines in slurry form are pumped into the formation. It has been determined that considerable unrecovered oil remains on the formation fines which are pumped into the formation.

Many industrial processes such as mining and oil recovery operations involve the treatment or handling of a solid which contains an oil. The solid may comprise fines suspended sand particles with globules of oil entrained thereon. Often, the oil is substantially removed prior to subsequent use or disposal of the fines. One method for removing oil from the fines is to use expensive surface treatment and separation methods. For example, oil is often removed from the fines in large settling basins. This treatment is generally ineffective for removing finely suspended oil on the sand particles. They are also very time consuming and costly.

Therefore, what is needed is a method to recover residual oil from fines or formation solids after placement of these fines or solids into a formation so as to facilitate the removal of oil therefrom.

SUMMARY

This invention is directed to a method for recovering residual or additional oil from fines or residue obtained while producing viscous oil from a reservoir. Initially, an aqueous slurry is made with the fines or residue. Most of the viscous oil has been removed from the fines prior to it being placed in the slurry. The slurry is of a consistency sufficient to be utilized in a hydraulic fracturing fluid. Subsequently, this slurry is incorporated into the fracturing fluid.

The fracturing fluid is then injected into a formation at a pressure and pumping rate sufficient to fracture the formation. Once the fracture has been created, the fines or residue in the fracturing fluid is disposed of in the fracture by releasing the fracturing pressure on the formation which causes it to settle. Afterwards, additional slurry is placed in the fracturing fluid and injected into the formation.

The fines from the slurry are allowed to remain in the formations fracture for a time sufficient for the fracturing fluid to leak oil into the formation. Once the fracturing fluid has leaked into the formation, additional oil is recovered from the fines by use of a non-thermal enhanced oil recovery operation. This enhanced oil recovery operation is a member selected from the group consisting of a solvent flood, surfactant flood, foam flood, or alcohol flood, and combinations thereof.

It is therefore an object of this invention to reclaim any residual oil from formation fines, residue, or sands which have been directed into a fracture in the formation.

It is another object of this invention to use a detrimental by-product, e.g. fines, in an economical manner by reclaiming residual oil therefrom.

It is a further object of this invention to reduce harm to the environment by avoiding the use of surface separation and reclamation processes for the recovery of residual oil from formation fines or sand.

DESCRIPTION OF THE PREFERRED EMBODIMENTS

In the practice of this invention residual oil is recovered from formation fines or sand which are injected into the formation. Fines which can be used herein are obtained during the recovery of viscous oil from a formation. Viscous oil as applied herein is that oil having an API gravity of 19° or less. Although the size of fines or sand will vary, it is preferred to use those of a size of from about 80 to about 400 mesh US Sieve. The size of the formation fines or sand is not critical. Fresh or salt water may be used for making the slurry. The slurry should be of a consistency sufficient to be utilized in a hydraulic fracturing fluid. For a more viscous fluid, a gel can be used. Great amounts of fines can be carried in a given quantity of fracturing fluid.

Once the desired consistency has been obtained, this slurry is mixed with the selected fracturing fluid. Pumping pressure is applied to the fracturing fluid with slurry therein for a time sufficient to fracture the formation when the formation conditions are considered. This pumping pressure is applied to at least one injection well which penetrates the formation. More than one injection well can be utilized if deemed necessary. A hydraulic fracturing method which can be utilized is described by Stowe et al. in U.S. Pat. No. 4,549,608 which issued on Oct. 29, 1985. Another hydraulic fracturing method which can be used is one where propping material is directed into the formation. This method is described in U.S. Pat. No. 3,896,877 which issued to Vogt, Jr. et al. on Jul. 29, 1975. These patents are hereby incorporated by reference herein.

After fracturing the formation to the extent desired, in one embodiment, the pressure on the formation is released and additional fines containing slurry is pumped into the injection well for disposal. This fracturing and slurry pumping process is repeated until the formation is unable to contain additional slurry with fines therein. When this occurs, the entire process can be initiated in another well until the desired quantity of fines has been disposed of.

In another embodiment, where it is not desired to fracture the formation, the fines or solids are mixed with an aqueous saline solution in an amount sufficient to make a slurry. The slurry is then injected into the formation at a rate and velocity sufficient to close pores in the formation without fracturing it. The concentration of the saline solution is held at a predetermined concentration so that pre-existing immobile formation fines will remain fixed. This method is disclosed in U.S. Pat. No. 4,787,452 which issued to Jennings, Jr. on Nov. 29, 1988. This patent is hereby incorporated by reference herein.

When formation fines have been placed into a desired area of a formation to the extent desired by either of these methods, the fines are allowed to remain in the formation for a time sufficient for the fracturing fluid to leak oil into the formation. Once this has occurred, a non-thermal enhanced oil recovery operation (EOR) is initiated in the formation to recover residual oil from the fines.

A water flooding process which can be used herein is disclosed by Hurd in U.S. Pat. No. 4,629,000 which issued on Dec. 16, 1986. This patent is hereby incorporated by reference herein. In this method, an injected fluid which consists of a oil slug containing preferentially oil-soluble alcohol and a preferentially oil-soluble ether-linked sulfate or sulfonate is directed into the area containing the fines. Specifically disclosed ether-linked surfactants include sulfonated or sulfated polyethoxylated alkylphenols. These alcohols include aliphatic alcohols containing from 5 to about 7 carbon atoms and those having a water solubility of less than 3%.

Residual oil can also be recovered from the fines by using a surfactant water flooding process as is disclosed by Stournes et al. in U.S. Pat. No. 4,113,632 that issued on Sep. 12, 1978. This patent is hereby incorporated by reference herein. Here, an aliphatic substituted succinimido aryl hydroxy sulfonate or its corresponding succinamic acid derivative is utilized.

Residual oil remaining on the fines or solids can be removed therefrom by the use of solvents. Solvents which an be used for this purpose include those having saturated liquid hydrocarbons with from 2 to about 10 carbon atoms in the molecules such as ethane, propane or LPG, butane, pentane, hexane and cyclohexane, octane, nonane, decane, and/or mixtures thereof. These and other solvents which can be used herein are disclosed in U.S. Pat. No. 4,844,158 which issued to Jennings, Jr. on Jul. 4, 1989. This patent is hereby incorporated by reference herein.

Obviously, many other variations and modifications of this invention as previously set forth may be made without departing from the spirit and scope of this invention as those skilled in the art readily understand. Such variations and modifications are considered part of this invention and within the purview and scope of the appended claims.

What is claimed:

1. A method for recovering additional oil from fines, sand, or residue obtained from viscous oil reservoirs comprising:

a) making an aqueous slurry with said fines or residue from which most of the oil has been removed which slurry is of a consistency sufficient to be utilized in a hydraulic fracturing fluid;

b) incorporating said slurry into said fracturing fluid;

c) injecting said fracturing fluid into a formation under pressure and conditions sufficient to fracture said formation;

d) fracturing said formation and thereby disposing of said fines in said formation by releasing the fracturing pressure on the formation and injecting additional said slurry into the formation;

e) allowing the fines from step d) to remain in the formation for a time sufficient for the fracturing fluid to leak-off into the formation; and f) recovering additional oil from the fines in step e) by use of a non-thermal enhanced oil recovery operation.

2. The method as recited in claim 1 where the enhanced oil recovering operation is a member selected from the group consisting of a solvent flood, surfactant flood, foam flood, or alcohol flood, and combinations thereof.

3. The method as recited in claim 1 where the sand or fines are of a size of from about 80 to about 400 mesh U.S. Sieve.

4. The method as recited in claim 1 where said fracturing fluid is injected into a well which penetrates said formation.

* * * * *